US006874439B2

(12) United States Patent
Conti

(10) Patent No.: US 6,874,439 B2
(45) Date of Patent: Apr. 5, 2005

(54) FLEXIBLE OCEAN-GOING VESSELS WITH SURFACE CONFORMING HULLS

(75) Inventor: Ugo Conti, El Cerrito, CA (US)

(73) Assignee: Marine Advanced Research, Inc., El Cerritos, CA (US)

( * ) Notice: Subject to any disclaimer, the term of this patent is extended or adjusted under 35 U.S.C. 154(b) by 0 days.

(21) Appl. No.: 10/373,307

(22) Filed: Feb. 24, 2003

(65) Prior Publication Data

US 2003/0164131 A1 Sep. 4, 2003

Related U.S. Application Data

(60) Provisional application No. 60/359,868, filed on Feb. 25, 2002.

(51) Int. Cl.[7] ..... B63B 1/00

(52) U.S. Cl. ..... 114/61.1; 114/283; 114/61.15

(58) Field of Search ..... 114/77 R, 77 A, 114/61.12, 61.15, 284, 352, 259, 61.19, 246, 66, 345, 61.1, 283

(56) References Cited

U.S. PATENT DOCUMENTS

| | | | | |
|---|---|---|---|---|
| 2,119,775 A | * | 6/1938 | Chase | 114/61.15 |
| 2,347,959 A | * | 5/1944 | Moore et al. | 114/283 |
| 2,391,326 A | * | 12/1945 | McKinley | 114/292 |
| 3,002,484 A | | 10/1961 | Dube | |
| 3,316,873 A | | 5/1967 | Dismukes | |
| 3,348,513 A | | 10/1967 | Dishart | |
| 3,659,546 A | * | 5/1972 | Miklos | 114/246 |
| 4,365,579 A | | 12/1982 | Perez, Jr. | |
| RE31,563 E | * | 4/1984 | Stout et al. | 114/283 |
| 4,495,880 A | | 1/1985 | Maniscalco et al. | |
| 4,968,274 A | | 11/1990 | Gregory | |
| 5,191,848 A | | 3/1993 | Hatfield | |
| 5,259,331 A | | 11/1993 | Hagan | |
| 5,657,715 A | | 8/1997 | Theriault | |
| 6,178,911 B1 | | 1/2001 | Hemphill et al. | |

FOREIGN PATENT DOCUMENTS

| | | |
|---|---|---|
| AU | 439997 | 8/1973 |
| FR | 2 590 861 A1 | 6/1987 |
| FR | 2 770 482 A1 | 5/1999 |

OTHER PUBLICATIONS

Conti, Ugo, "Una Storia D'Amore Con Il Mare", 1995, Gruppo Ugo Mursia Editore S.p.A., Milano, Italy.
Conti, Ugo, "Crazy by Design", 1998, Lisardco, Berkeley, California.

* cited by examiner

*Primary Examiner*—Ed Swinehart
(74) *Attorney, Agent, or Firm*—Blakely, Sokoloff, Taylor & Zafman LLP

(57) ABSTRACT

The vessel has a pair of flexible hulls flexibly coupled to a "cabin" between and above the hulls, thereby allowing the hulls to independently follow the surface of the water. Motor pods are hinged to the back of the hulls to maintain the propulsion system in the water, even if the stern of one or both hulls tends to lift out of the water when crossing swells and the like. Various other embodiments and features are disclosed.

37 Claims, 10 Drawing Sheets

FLEXIBLE OCEAN-GOING VESSELS WITH SURFACE CONFORMING HULLS

CROSS-REFERENCE TO RELATED APPLICATION

This application claims the benefit of U.S. Provisional Patent Application No. 60/359,868 filed Feb. 25, 2002.

BACKGROUND OF THE INVENTION

1. Field of the Invention

The present invention relates generally to marine vessel design.

2. Prior Art

Ocean-going vessels and, in general, watercrafts, rely on three methods to negotiate the surface on water bodies:

1) "DISPLACEMENT": this method is used by vessels with displacement hulls that will remain always partially immersed. The energy supplied by the power plant is transferred, by means of propellers or water jets, to the water that has to be moved to permit the forward motion of the vessel.

2) "PLANING": this method is used by vessels with planing hulls. In these vessels the energy from the power plant is used to lift the hull out of the water. This is achieved with a bottom design that presents a hydrodynamically lifting surface to the water: the upward force thus generated at planing speed, is sufficient to lift the vessel partially out of the water. This reduces the wetted surface of the hull and the amount of water that has to be displaced to allow forward motion.

3) "PIERCING": this method has been used recently to design vessels capable of high speed in rough waters and is used chiefly in catamarans. In this design, the hulls are very narrow and have very sharp bows; this permits the vessel to go through the waves with reduced resistance.

It is interesting to note that in all of these conventional designs, there is a kind of violence that is done to the waves, a disruption of the natural flow of the water in motion that limits the attainable speed for a given power plant and vessel length. Most importantly, conventional designs subject the mechanical structure of the vessel to tremendous impacts as the speed is increased. These impacts create stresses in the materials that require additional strength, and thus weight, to be added to the design of the vessel. As a consequence, power has to be increased, with further increase in weight and so on. Range, which implies fuel weight, is also a parameter that is influenced by wave disruption: for this reason, fast vessels of limited size have generally limited range.

BRIEF SUMMARY OF THE INVENTION

The present invention provides the fundamentals for the design of an entirely different type of vessel that creates the minimum possible disruption of the waves. In other words, this vessel does not push, slap or pierce the waves but instead "DANCES" with them.

The invention utilizes flexibility to change and adjust the vessel's structure and form to the water surface, instead of adjusting or changing the water to conform to the vessel. This method of adjusting the shape of the structure in motion to a fixed surface is used in skis that must follow the variation of the snow surface and absorb the shocks involved with moving over that surface at high speed.

The vessel has a pair of flexible hulls flexibly coupled to a "cabin" between and above the hulls, thereby allowing the hulls to independently follow the surface of the water. Motor pods are hinged to the back of the hulls to maintain the propulsion system in the water, even if the stern of one or both hulls tends to lift out of the water when crossing swells and the like. Various other embodiments and features are disclosed.

DETAILED DESCRIPTION OF THE PREFERRED EMBODIMENTS

The type of boat design that lends itself most easily to the implementation of this invention is the catamaran. There are two main components in a catamaran: the twin hulls and the structure that holds the hulls together. This invention requires the hulls and the connecting structure to be made of such materials as to provide a high degree of flexibility and shock absorbing capability. Thus the hulls could be made of inflatable rubberized fabric (like nylon reinforced polyurethane) and the connecting structure with composite materials (like carbon reinforced epoxy, glass reinforced thermoplastics, etc.).

A problem for all existing power catamarans is the fact that, due to the wide beam necessary for stability, the stern sections of the hulls tend to come out of the water in a seaway, thus causing the propeller of the power plant to cavitate and lose forward driving force. This invention solves this problem by separating the stern section of each hull from the main hull. Each stern section is connected to its main hull by a horizontal hinge that allows up and down movements of the stern as it follow the water surface: this keeps the propeller immersed and driving at all times. The movements of such stern section can be actively controlled by servomechanisms like computer controlled hydraulics, passively controlled such as by hydraulic damping devices acting between the stern section and the respective main hull, or controlled simply by its own configuration and dynamics relative to its respective main hull.

A further advantage of the inflatable hulls made of flexible material is that very large vessels of very light weight can be constructed. The large size allows the vessel to negotiate heavier seas and the light weight allows much higher speeds than would be possible with a conventional vessel of equivalent driving power.

Figure 1A:
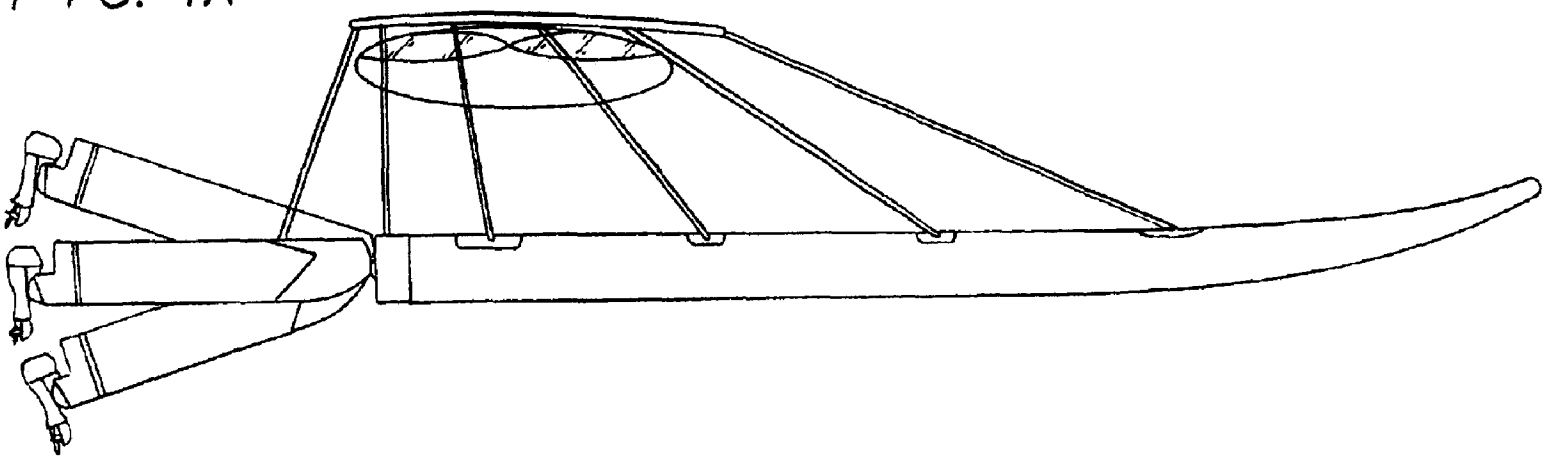
FIGS. 1*a*, 1*b* and 1*c* are a side view, a top view and a front view, respectively, of one embodiment of the present invention.
Figure 1C:
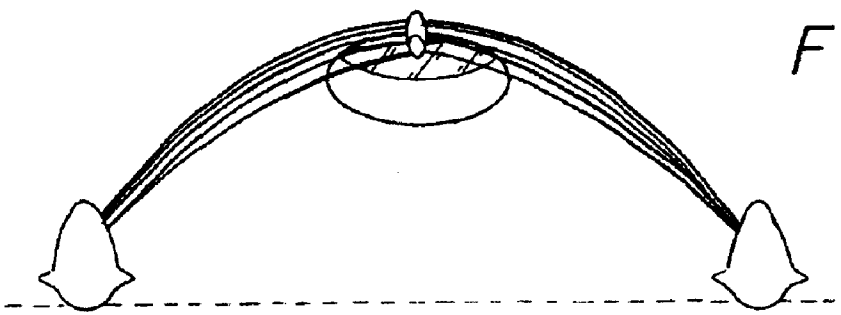
Figure 1B:
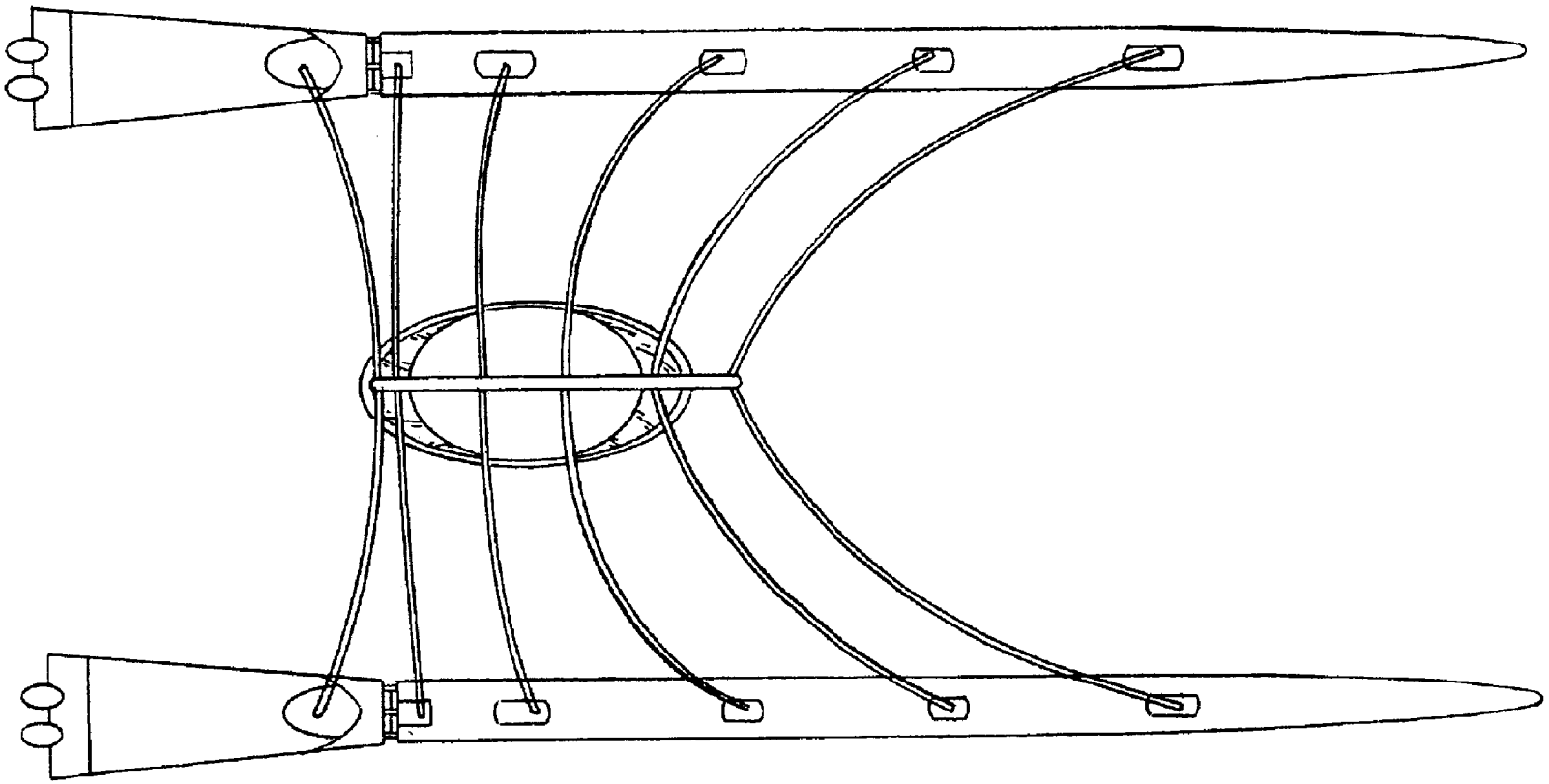

FIGS. 1*a*, 1*b* and 1*c* show a possible embodiment of the invention described above. This vessel is 140 feet long overall, 70 feet wide, is powered by outboards 20 (inboards or turbines might alternatively be used) of total power in the range of 1000 hp, has a flexible structure 22 between the hulls 24 made of composite material struts 26 and has a cabin 28 suspended elastically under the flexible structure. The cabin 28 can be designed as a self-contained lifeboat that can be quickly released from the main vessel in case of emergency. It also may be interchangeable with "cabins" of other designs and functions, such a one cabin for passengers, another for rescue operations or for hauling cargo, etc.

The motor pods 30 are connected to the main hulls 24 by strong hinges 32 and may be limited in their up-down swing such as by suitable flexible elements and/or hydraulic shock absorbers. Control of the engines from the cabin may be by or within flexible members or hydraulics, by way of example, running from the cabin to the motor pods, or from the cabin to the hulls, and from there to the motor pods by the same or a different form of control.

The hulls and stern sections (motor pods) may be compartmentalized like an inflatable life raft or dinghy so that a puncture of one compartment will not deflate the entire hull. Similarly, each compartment may include a fuel storage sub compartment to distribute the fuel weight, particularly for long range operation of the vessel. In that regard, fuel may be stored in the motor pods, the main hulls or both, as desired.

The vessel described in FIGS. 1*a*, 1*b* and 1*c* with a crew of 5 and fuel for 2000 mile range has a calculated displacement of 6000–7000 kg and should reach cruising speeds in excess of 60 kn.

Figure 2:
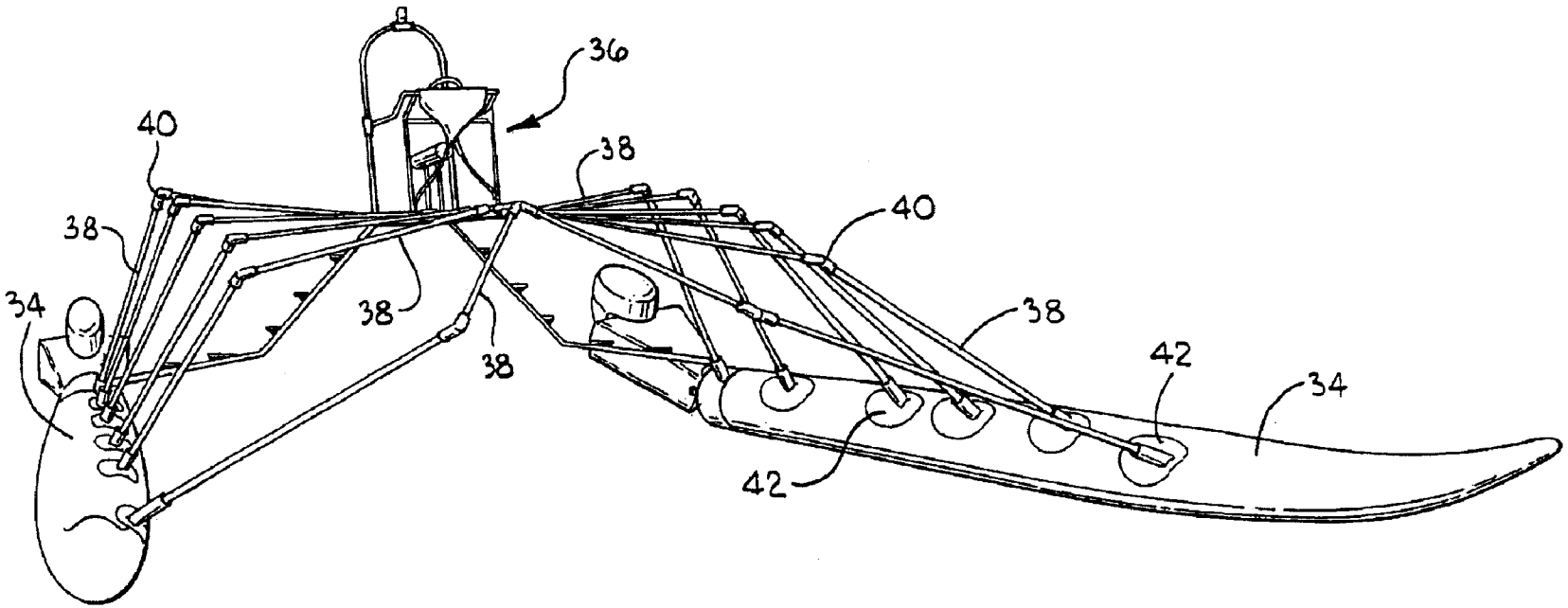
FIG. 2 is a perspective view of another embodiment of the present invention.
Figure 3:
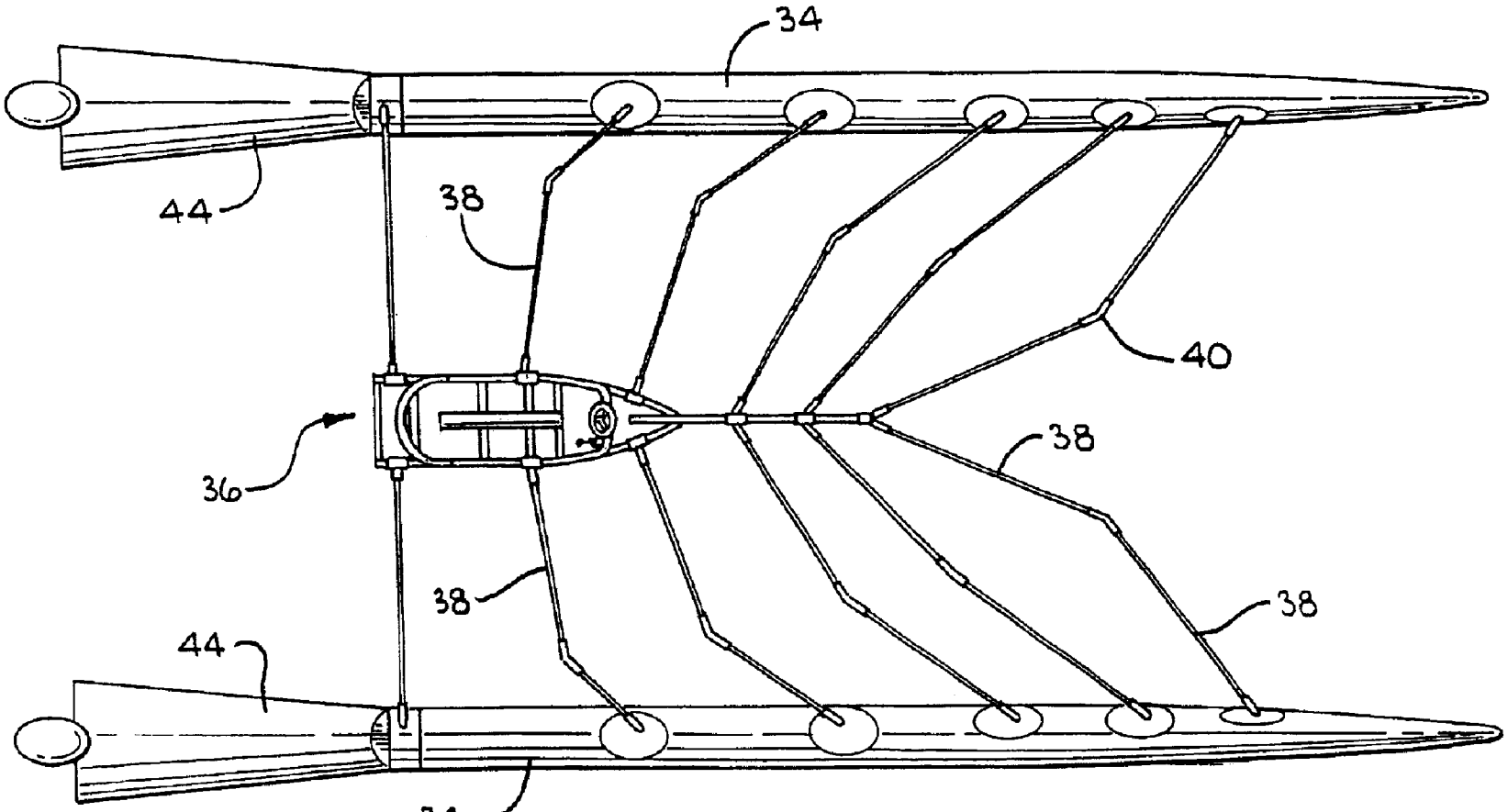
FIG. 3 is a top view of the embodiment of FIG. 2.
Figure 4:
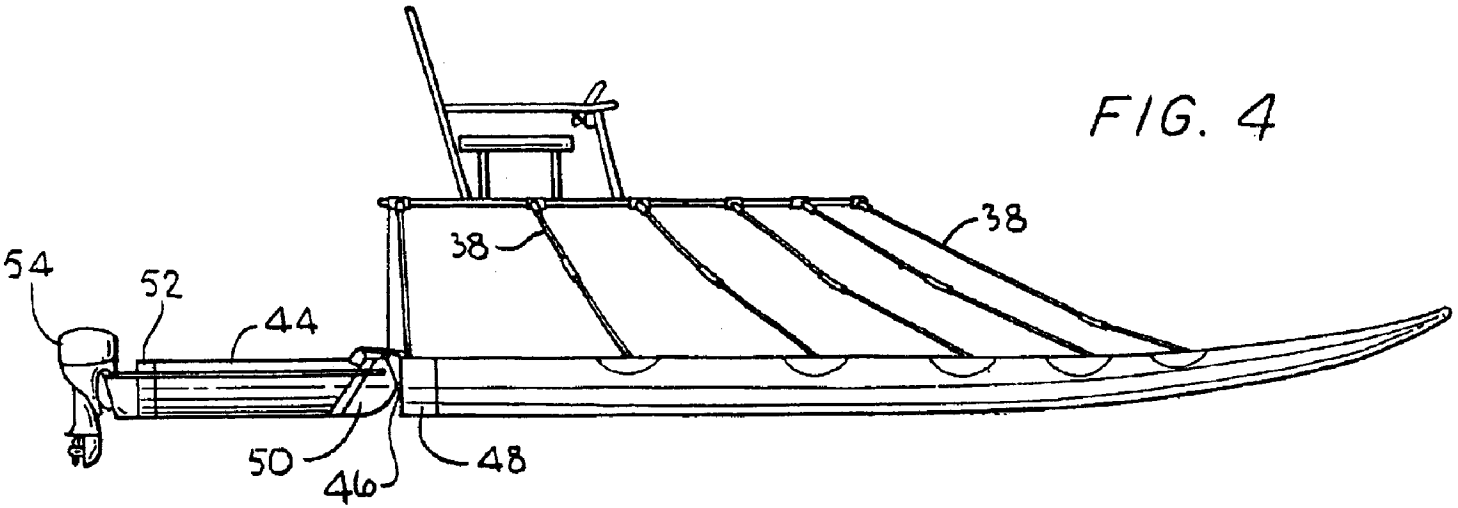
FIG. 4 is a side view of the embodiment of FIG. 2.

Now referring to FIGS. 2, 3 and 4, another embodiment of the present invention may be seen. This embodiment is physically smaller than the prior embodiment, in one incarnation being approximately 40 feet in length. The flexible structure between hulls 34 and the cabin or cockpit, generally indicated by the numeral 36, in this case more in the form of a control platform for a single operator, is comprised of composite tubular members 38. The tubular members in this embodiment are straight, filament wound composite members joined together in pairs by elbow or corner members 40. One distal end of each pair of tubular members is substantially "rigidly" attached to the hulls 34 by pads 42 bonded or otherwise attached to the inflatable hulls to distribute the load on the inflatable hull, with the opposite distal end of each pair being rigidly joined to the cabin or platform 36.

Figure 9:
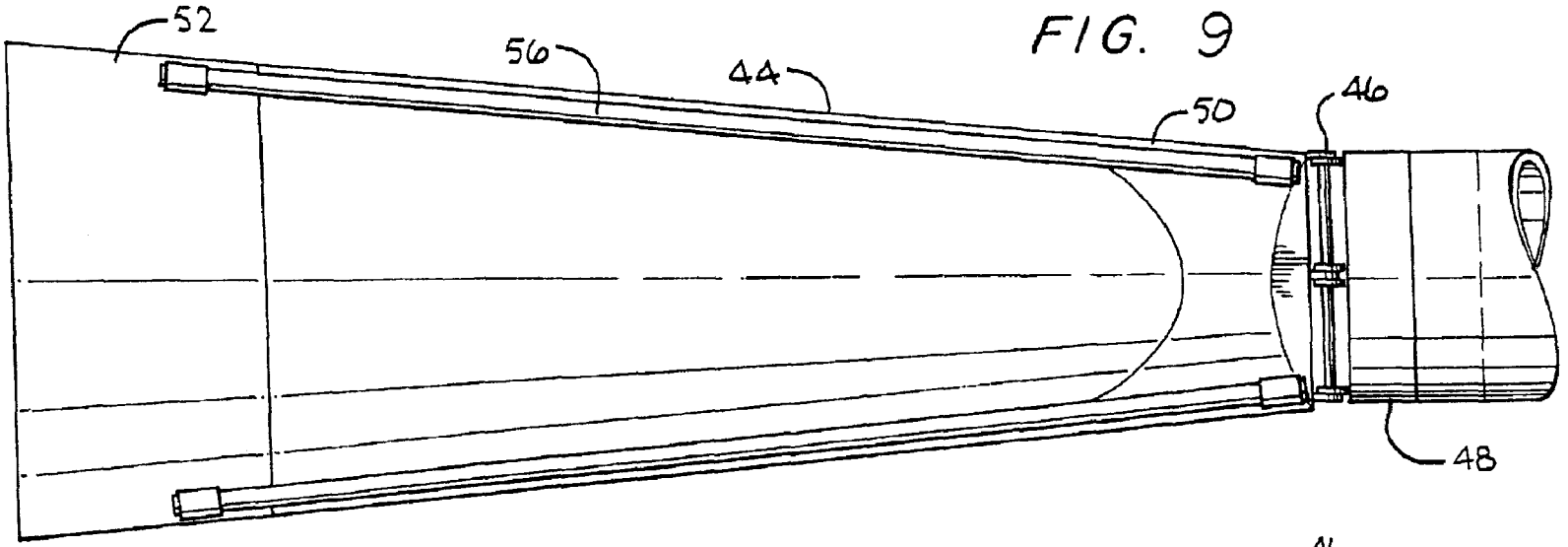
FIG. 9 is a top view of an engine pod illustrating the coupling of the bow and stern portions thereof.
Figure 10:
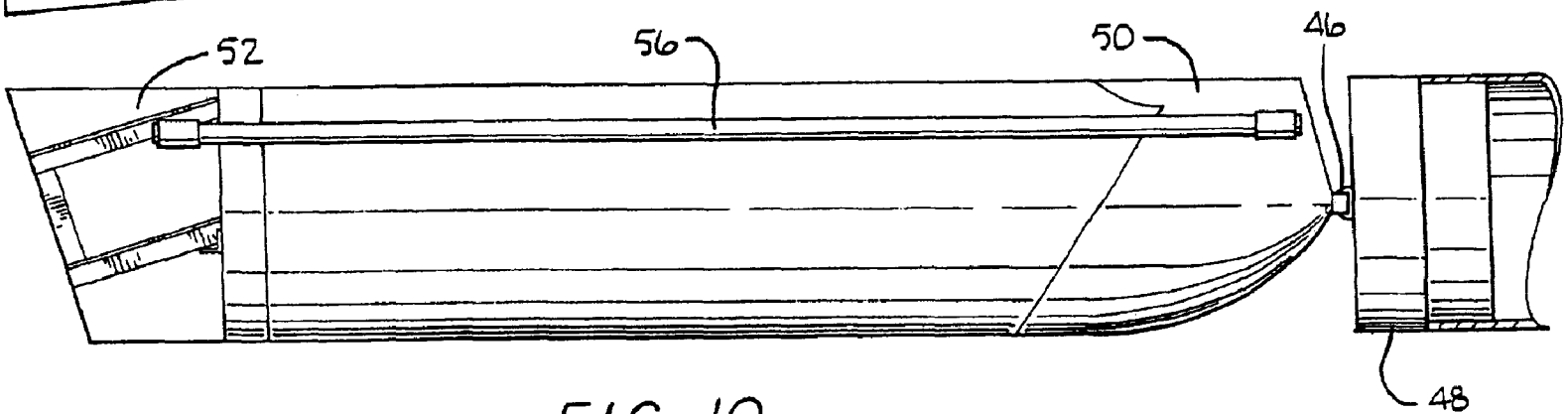
FIG. 10 is a side view of an engine pod illustrating the coupling of the bow and stern portions thereof.
Figure 11A:
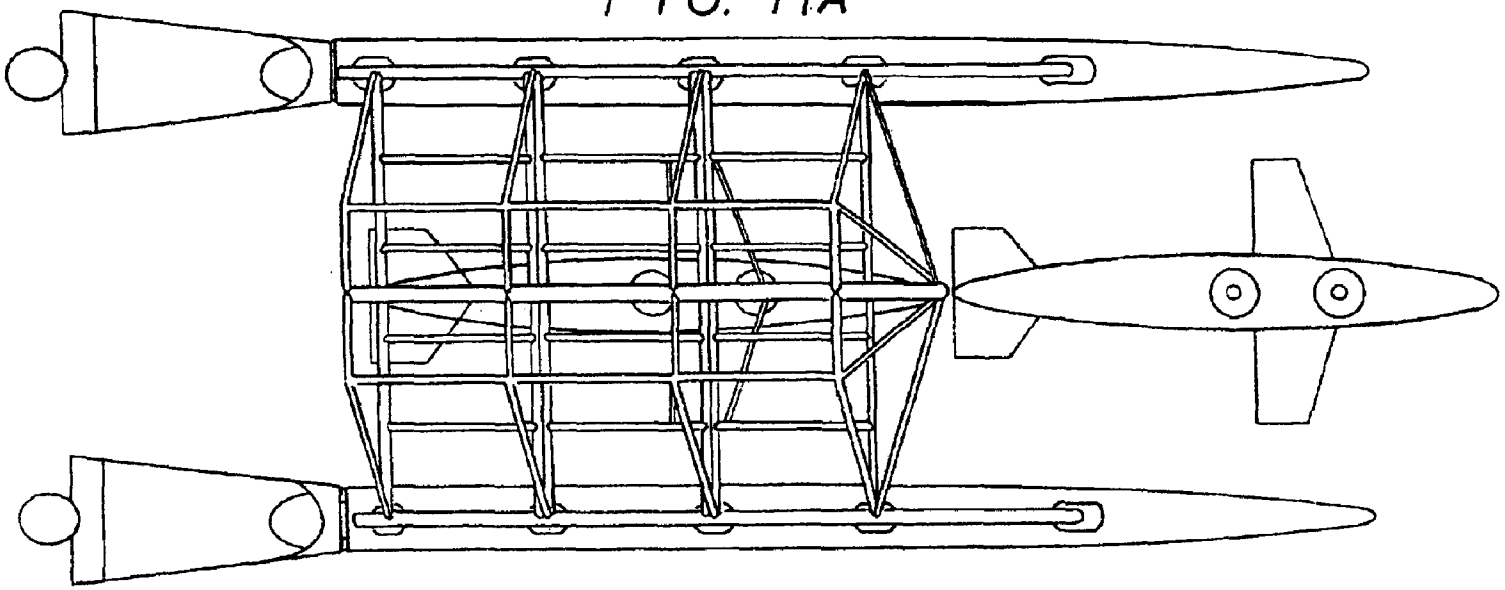
FIGS. 11*a*, 11*b*, 11*c* and 11*d* illustrate the use of an embodiment of the present invention for carrying and release and retrieval of another object or water vehicle, such as a submarine, a remotely operated vehicle or instrumentation package.
Figure 11B:
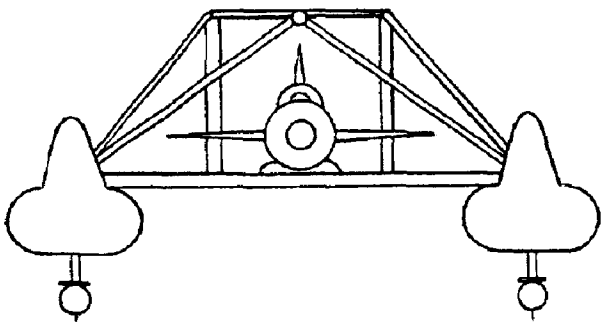
Figure 11C:
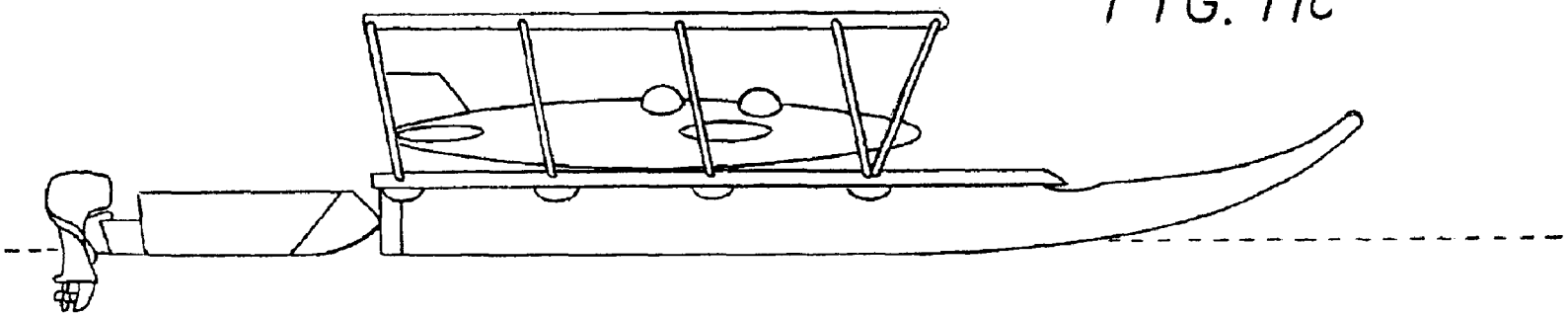
Figure 11D:
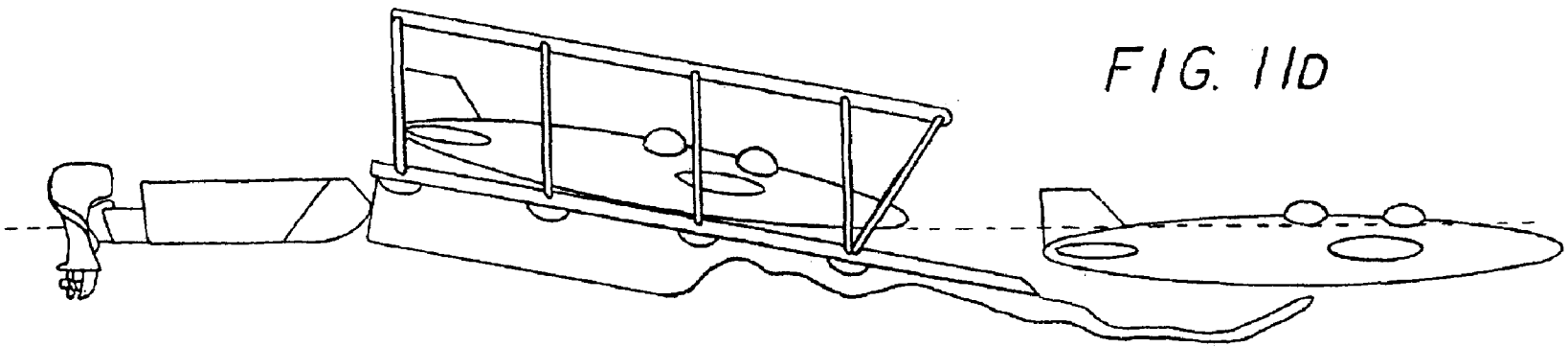

As before, motor pods 44 are hinged to the hulls 34 by hinges 46, best seen in FIG. 4. These hinges may be single door-type hinges fastened to the rear of the hulls in the forward section of the motor pods. In that regard, the stern 48 of the hulls, as well as the forward portion 50 of the motor pods 44, are preferably rigid members of metal or composite materials, such as fiberglass, to distribute the loads on the hinges across the periphery of the inflatable section. The front of the motor pods is preferably streamlined to reduce drag. Similarly, the stern 52 of the motor pods is also rigid to provide support for the outboard engine 54 supported thereon. If another form of propulsion is used, such as water jets, the engines driving the water jets may be positioned more forward in the motor pods 44, as desired. In either event, the motor pods 44 may have fiber reinforced composite tubes or rods 56 therein, as shown in FIGS. 9 and 10, to retain orientation of the stern section 52 of the motor pod with respect to the bow section 50 of the motor pod. Also, more visible in these Figures are the hinges 46, though substantially any hinge configuration, including hinges simply comprising flexible members joining the hulls and motor pods, may be used. In that regard, the motor pods may be interchangeable with motor pods of other configurations, particularly with other power plants for other applications of the watercraft, such as outboards for high speed operation and water jets for shallow water operation, beaching and the like.

In the embodiments disclosed herein, the motor pods taper outward to a bigger cross-sectional area at the stern thereof to provide better flotation for the weight of the engines when the vessel is not moving or is moving at slow speed. In other embodiments, however, the outward taper might not be used. By way of example, in a configuration using a water jet, the engine may be positioned further forward in the motor pod, better distributing the engine weight along the length of the motor pod and even coupling some of the engine weight to the stern of the respective hull.

Figure 5:
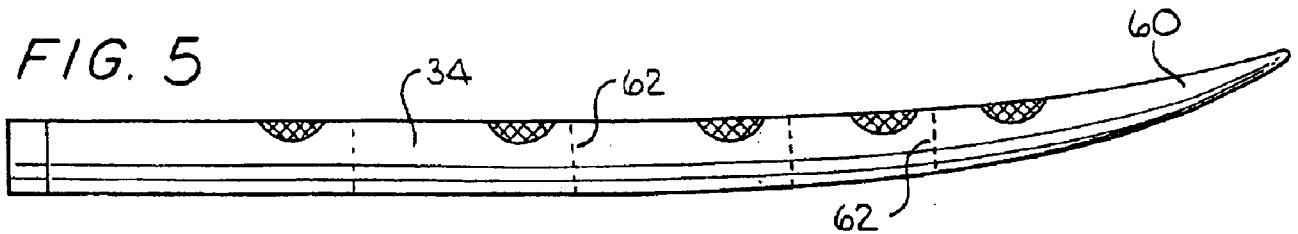
FIG. 5 is a side view of one of the hulls of the embodiment of FIGS. 2 through 4.
Figure 6:
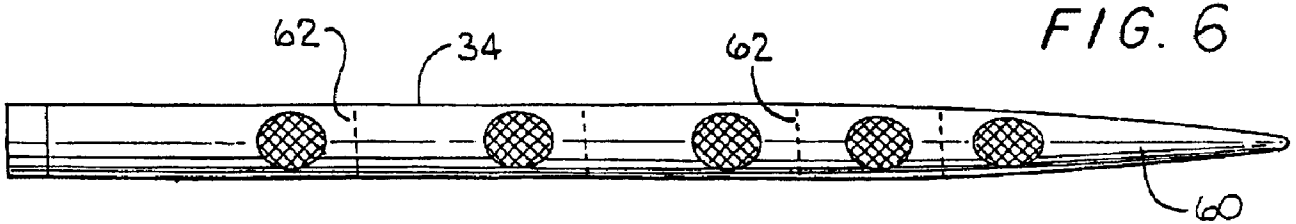
FIG. 6 is a top view of one of the hulls of the embodiment of FIGS. 2 through 4.
Figure 7:
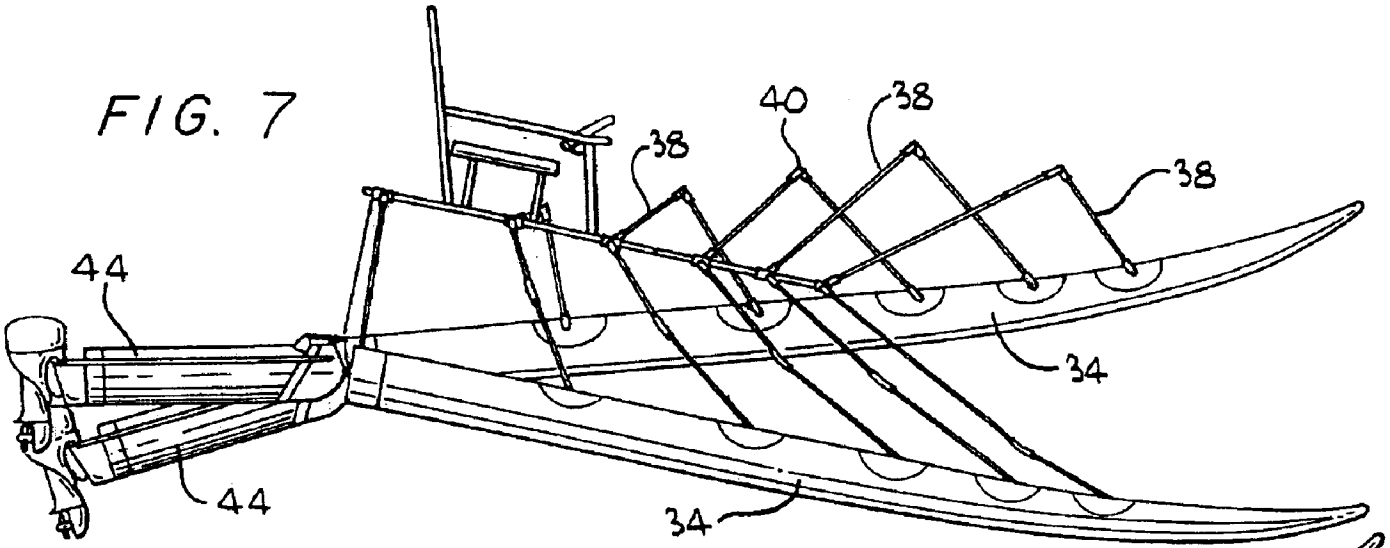
FIGS. 7 and 8 illustrate the independent motion of the hulls and motor pods of the embodiment of FIGS. 2 through 4.
Figure 8:
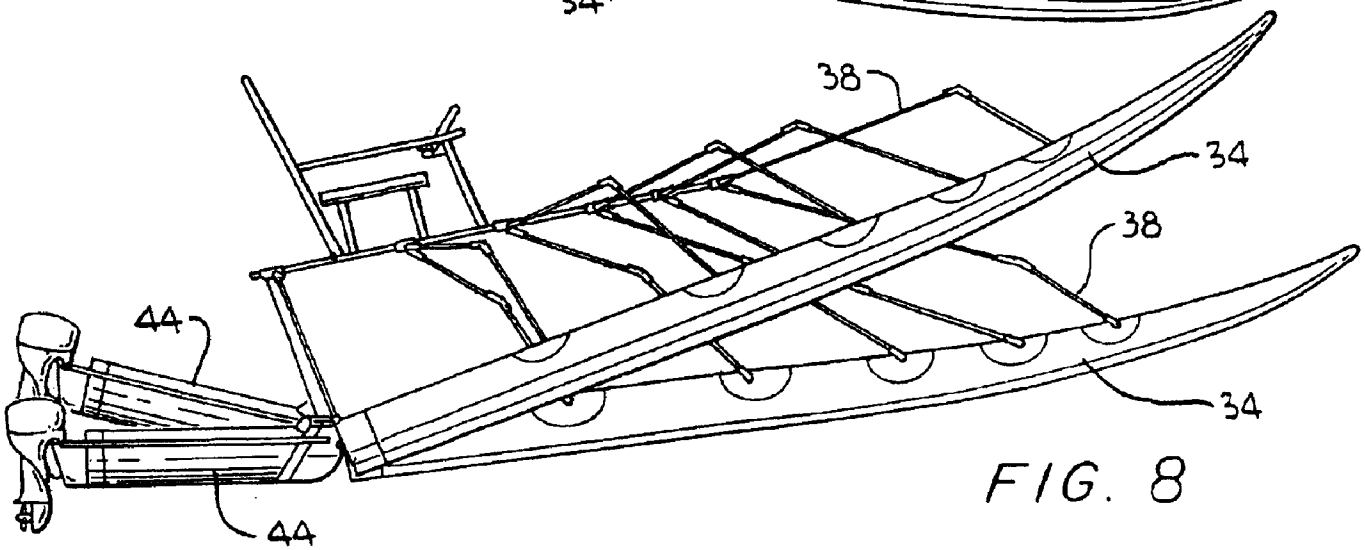

FIGS. 5 and 6 present a side view and a top view, respectively, of one of the hulls 34. In general, the hulls preferably are of a uniform circular cross-section through most of their length (when not deflected), with a tapering, upturned nose portion 60. Because the hulls of this and other embodiments are coupled to the cabin through flexible members, the hulls may in general independently follow the surface of the water, as may the motor pods. For instance, FIGS. 7 and 8 illustrate the independent motion of hulls 34 as one might encounter when crossing swells at an angle. The hinging of the motor pods, in this embodiment the motor pods 44 to the hulls 34, allows the stern of the motor pods, and more particularly the propeller and associated lower part of the outboard engines (or water jet intake, etc.), to remain in the water, even if the stern of one or both hulls 34 may tend to lift out of the water. Thus, the flexible members 38 cushion the ride as well as allow independent motion of each hull to allow the hull to pass over the water surface at a high speed without pushing the water aside, and thus without the high energy loss of forcing the water out of the way, so to speak.

Also shown in phantom on FIGS. 5 and 6 are the flexible "bulkheads" 62 that compartmentalize the hulls. This provides not only a safety feature, but may also allow the adjustment of inflation pressure for each compartment to minimize drag and provide the desired ride over the waves.

FIGS. 7 and 8 illustrate the independent motion of the hulls and motor pods in parallel vertical planes. The flexibility provided may also allow some movement of the hulls in a horizontal plane. In that regard, one can imagine a possible stability problem, particularly if, when the hulls move further apart, they tend to toe out, and when they move closer together they tend to toe in. To avoid this, preferably the axes of the hulls will remain in substantially parallel vertical planes when deflecting further apart or closer together. If however, any such instability is encountered in a particular implementation of the present invention, damping devices may be provided in or across the flexible support, between the cabin and hulls or even between hulls, as desired. In that regard, in the two specific embodiments disclosed herein, the flexible members extend between the hulls and the cabin, though it is to be understood that in other embodiments, one or more flexible members might extend between hulls. By way of but one example, a flexible member might couple the forward portions of the two hulls to maintain a substantially constant separation between those regions of the hulls to prevent the possible instability hereinbefore mentioned. However, in a prototype in accordance with the embodiment of FIGS. 2 through 10, no such instability has been encountered, probably because of the relatively keel-less design and the damping effect of the water.

Commercial applications of this type of vessel are, but are not limited to:

1) very fast rescue vessels with great range, soft sides and the possibility of retrieving people in the water with the technologies used by helicopters;
2) very fast patrol service with a more extended range than conventional ones;
3) pleasure crafts that can operate, in similar seas, at twice the speed of existing vessel with the same power;
4) manned or unmanned military vessels with very limited radar signature, low cost and light payload, capable of landing on beaches through heavy surf;
5) oceanographic vessels for deployment of ROVs, submarines or other instrumentation: these research systems can be deployed and retrieved between the hulls from the cabin without the need of heavy cranes on large vessels. It can be noted that a possible embodiment of this application is the following: the forward part of the hulls can be deflated and sunk to allow, say, a submarine to slide in the water or be pulled aboard on the ramp thus created. After these operations are completed, the hulls can be reinflated with on-board air pumps and the sailing asset of the vessel restored. This last embodiment is shown in FIGS. 11*a* through 11*d*.

Figure 12:
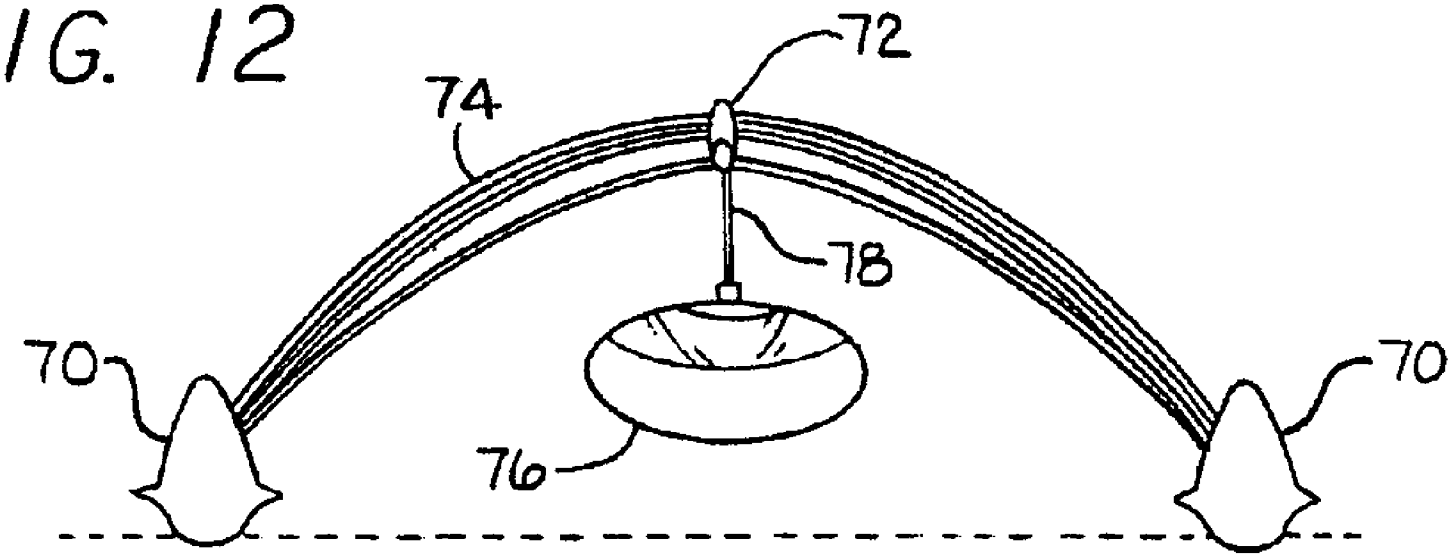
FIG. 12 illustrates the separation of the module from the rest of the structure for such purposes as use as a separate watercraft or for changing modules for different applications.

Now referring to FIG. 12, another embodiment of the invention incorporating features which may easily be incorporated in any of the other embodiments of the present invention may be seen. As shown in that Figure, hulls 70 are coupled to a center structure 72 through one or more connecting members 74 which may be rigid or flexible, as desired. While multiple members 74 are shown in the Figure, single streamlined structures may be used on each side of the center structure 72 to rigidly support the same over and between the two hulls 70. The module 76 is detachably coupled to the center structure 72, so as to be releasable as desired. In the embodiment shown in FIG. 12, one or more cables 78 may be used to lower the module 76 to the water, with the module 76 being detachable from the cable so as to itself serve as a separate watercraft. Such an arrangement is particularly convenient to provide a self-contained life raft in the case of an emergency. Also, module 76 may be provided with its own propulsion system to serve as a shore boat or tender. In that regard, while module 76 may use substantially any type of power plant, a small water jet may have advantages in some applications as being aesthetically pleasing when the module is in its normal elevated position, being functional around harbors and suitable for shallow water operation and even beaching of the module, as may be desired in some applications. In that regard, for such uses, the module itself need not have high speed or long range capabilities when so detached. Also, the ability to detach the module allows the interchanging of modules for different functions, such as for cargo carrying or passenger carrying, or for that matter, for interchanging modules of the same function. By way of example, improved utility of the basic watercraft having such a feature might be achieved by being able to detach a loaded cargo module at a first destination and to immediately pick up another cargo module loaded with a different payload for the next destination without having to wait for a module having to be unloaded and reloaded.

In the embodiments disclosed herein, the flexible hulls and engine pods are inflatable structures, as suitable materials and construction techniques are well known and inflation may be varied to obtain the best performance or the resulting watercraft. However, other flexible materials might also be used instead or in addition to inflatable structures. By way of example, foam or foam filled or partially foam filled structures might be used, alone or together with inflatable structures to obtain greater flexibility in the cross-sectional shape of the hulls and/or engine pods, and tailored rigidity and flexibility alone or around the hulls. As another example, the hulls might be inflatable, with the engine pods being closed cell foam filled or substantially foam filled to prevent the engine pods from sinking, even if punctured by flotsam. Thus, while the present invention has been disclosed with respect to certain specific embodiments, such disclosure has been for purposes of illustration and not for purposes of limitation. Thus, many other embodiments will be obvious to those skilled in the art, all within the spirit and scope of the invention.

What is claimed is:

1. A watercraft comprising:

first and second hulls; and, a module adapted to carry a load above a water surface;

the module being coupled to flexible members coupled to the first and second hulls;

each hull having a forward hull section and an aft hull section, the aft hull sections each being flexibly coupled to the respective forward hull section;

whereby the hulls may independently follow the surface of the water while supporting the module above the surface of the water.

2. The watercraft of claim 1 wherein an engine for propelling the watercraft is mounted in each aft hull section.

3. The watercraft of claim 2 wherein the engines comprise outboard engines.

4. The watercraft of claim 1 wherein the load comprises an operator/passenger.

5. The watercraft of claim 1 wherein the hulls are inflatable.

6. The watercraft of claim 1 wherein the forward hull sections terminate at the forwardmost region with a tapered, upward turned bow section.

7. The watercraft of claim 6 wherein the reminder of the forward hull section is of a substantially constant cross section.

8. The watercraft of claim 7 wherein the aft hull sections each have a forward region of substantially the same cross section of the aft portion of the respective forward hull section; and taper out to a larger cross section adjacent the rear of the respective aft hull section.

9. The watercraft of claim 1 wherein each forward hull section is comprised of a plurality of separate inflatable compartments.

10. The watercraft of claim 9 wherein compartments of each forward hull section may be deflated to submerge part of the forward hull section for ease of loading and unloading the load carrying module.

11. The watercraft of claim 1 wherein compartments of each forward hull section may be deflated to submerge part of the forward hull section for ease of loading and unloading the load carrying module.

12. The watercraft of claim 1 wherein the forward and aft hull sections are flexibly coupled by hinge members.

13. The watercraft of claim 12 wherein the hinge members have substantially coaxial hinge axes.

14. The watercraft of claim 1 wherein the flexible members are composite members.

15. The watercraft of claim 1 wherein the module is detachably coupled to a structure coupled to the flexible members, whereby the module is replaceable by other modules.

16. A watercraft comprising:

first and second hulls; and, a module adapted to carry a load above a water surface;

the module being coupled to a structure coupled to flexible members coupled to the first and second hulls, the module being adapted for lowering to the water to serve as a separate watercraft;

whereby the hulls may independently follow the surface of the water while supporting the module above the surface of the water.

17. A watercraft comprising:

first and second hulls; and, a module adapted to carry a load above a water surface;

the module being coupled to a structure coupled to flexible members coupled to the first and second hulls, the module being adapted for lowering to the water to serve as a lifeboat;

whereby the hulls may independently follow the surface of the water while supporting the module above the surface of the water.

18. A watercraft comprising:

first and second flexible hulls;

first and second motor pods, each flexibly coupled to a respective flexible hull; and, a module adapted to carry a load above a water surface;

the module being coupled to flexible members coupled to the first and second flexible hulls;

whereby the flexible hulls and motor pods may independently follow the surface of the water while supporting the module above the surface of the water.

19. The watercraft of claim 18 wherein an engine for propelling the watercraft is mounted in each motor pod.

20. The watercraft of claim 19 wherein the engines comprise outboard engines.

21. The watercraft of claim 18 wherein the load comprises an operator/passenger.

22. The watercraft of claim 18 wherein the flexible hulls are inflatable.

23. The watercraft of claim 22 wherein each flexible hull is comprised of a plurality of separate inflatable compartments.

24. The watercraft of claim 23 wherein compartments of each flexible hull may be deflated to submerge part of the flexible hull for ease of loading and unloading the load carrying module.

25. The watercraft of claim 18 wherein the flexible hulls terminate at the forwardmost region with a tapered, upward turned bow section.

26. The watercraft of claim 25 wherein the remainder of the flexible hulls are of a substantially constant cross section.

27. The watercraft of claim 26 wherein the motor pods each have a forward region of substantially the same cross section of the aft portion of the respective flexible hull, and taper out to a larger cross section adjacent the rear of the respective motor pod.

28. The watercraft of claim 18 wherein each flexible hull is comprised of a plurality of separate inflatable compartments.

29. The watercraft of claim 28 wherein compartments of each flexible hull may be deflated to submerge part of the flexible hull for ease of loading and unloading the load carrying module.

30. The watercraft of claim 18 wherein the flexible hulls and respective motor pods are flexibly coupled by hinge members.

31. The watercraft of claim 30 wherein the hinge members have substantially coaxial hinge axes.

32. The watercraft of claim 18 wherein the flexible members are composite members.

33. The watercraft of claim 18 wherein each flexible hull terminates at a forwardmost region with a tapered, upward turned bow section.

34. The watercraft of claim 18 wherein the module is detachably coupled to a structure coupled to the flexible members, whereby the module is replaceable by other modules.

35. The watercraft of claim 18 wherein the module is coupled to a structure coupled to the flexible members, the module being adapted for lowering to the water to serve as a separate watercraft.

36. The watercraft of claim 18 wherein the module is coupled to a structure coupled to the flexible members, the module being adapted for lowering to the water to serve as a lifeboat.

37. A watercraft comprising:

first and second inflatable hulls;

first and second inflatable motor pods, each hinged to a respective flexible hull;

first and second engines, each engine being mounted in a respective motor pod; and, a module adapted to carry a load above a water surface;

the module being coupled to flexible members coupled to the first and second hulls;

whereby the hulls and motor pods may independently follow the surface of the water while supporting the module above the surface of the water.

* * * * *